US005987829A

United States Patent [19]

Fisher

[11] Patent Number: 5,987,829

[45] Date of Patent: Nov. 23, 1999

[54] CONSTRUCTION BLOCK

[76] Inventor: Myles A. Fisher, 2006 E. Mallory St., Pensacola, Fla. 32503

[21] Appl. No.: 09/115,172

[22] Filed: Jul. 14, 1998

Related U.S. Application Data

[63] Continuation-in-part of application No. 09/048,420, Mar. 25, 1998, which is a continuation-in-part of application No. 08/603,460, Feb. 20, 1996.

[51] Int. Cl.[6] ..... E04B 5/46; E04C 1/42

[52] U.S. Cl. ..... 52/306; 52/307; 52/308; 52/204.62; 52/235; 52/588.1

[58] Field of Search ..... 52/306, 307, 308, 52/235, 204.62, 204.63, 574, 779, 780, 588.1

[56] References Cited

U.S. PATENT DOCUMENTS

| | | | |
|---|---|---|---|
| 1,025,406 | 5/1912 | Koenig | 52/591.2 |
| 2,655,032 | 10/1953 | Zagray | 52/591.1 |
| 2,970,218 | 1/1961 | Shaw | 250/517.1 |
| 3,148,477 | 9/1964 | Bjorn et al. | 52/591.2 |
| 3,410,044 | 11/1968 | Moog | 52/309.12 |
| 3,818,656 | 6/1974 | Vigliotti | 52/100 |
| 3,834,100 | 9/1974 | Healey | 52/309.1 |
| 3,905,170 | 9/1975 | Huettemann | 52/591.1 |
| 4,075,808 | 2/1978 | Pearlman | 52/439 |
| 4,258,522 | 3/1981 | Amaral | 52/591.2 |
| 4,566,235 | 1/1986 | Groll | 52/220.2 |
| 4,793,104 | 12/1988 | Hultberg et al. | 52/127.3 |
| 5,033,245 | 7/1991 | Kline | 52/306 |
| 5,038,542 | 8/1991 | Kline | 52/306 |
| 5,588,271 | 12/1996 | Pitchford | 52/306 |
| 5,595,033 | 1/1997 | Frey | 52/306 |
| 5,836,125 | 11/1998 | Regina | 52/306 |
| 5,904,019 | 5/1999 | Kooij et al. | 52/306 |
| 5,910,086 | 6/1999 | Fisher | 52/306 |

*Primary Examiner*—Carl D. Friedman
*Assistant Examiner*—Jennifer I. Thissell
*Attorney, Agent, or Firm*—Peter Loffler

[57] ABSTRACT

A construction block comprises parallel faces joined by four side edges. Two side edges have outer spacing flanges while the other two sides have inner spacing flanges. Hook receptacles are located on the lower portion of the inner spacing flanges and face away each other, while corresponding hooks are located along the outer spacing flanges and are adapted to be received within a corresponding hook receptacle when the a construction block is interconnected with the another of the construction block. A structural bar is positionable within the recess of the inner spacing flanges.

18 Claims, 6 Drawing Sheets

30
16
34
32
30
18
36
34
20
34
34
10
24
14
24
34
24
34
12
38
36
24
30
24
24
20

20
30
24
26
14
20
16
30
24
18
24
24
34
10
34
24
34
24
12
24
34
20
34
30
34
24
26

CONSTRUCTION BLOCK

This application is a continuation-in-part of application Ser. No. 09/048,420 filed on Mar. 25, 1998 which is a continuation-in-part of 08/603,460 filed on Feb. 20, 1996.

BACKGROUND OF THE INVENTION

1. Field of the Invention

The present invention relates to an interfitting construction block.

2. Background of the Prior Art

Glass and glasslike partition walls are a regular part of modern construction. These walls, which can be either internal or external, are made from transparent or translucent glass, or more often, plastic blocks interfitted to form the wall.

My application Ser. No. 08/603,460 filed on Feb. 20, 1996 identified several drawbacks associated with then-current construction blocks and provided a solution to address these problems. The present construction block system continues to address such solutions and provides additional versatility during the manufacturing and assembling process.

SUMMARY OF THE INVENTION

The construction block of the present invention meets the aforementioned needs in the art provides for a construction block that interconnects to another construction block almost instantaneously. The device permits part of the block to be cut away in order to permit non-rectangular-shaped partition wall construction. Partial failure of the connection means on the construction block of the present invention will not result in partition wall failure.

The construction block of the present invention is comprised of a generally rectangular block having a pair of parallel faces joined by four side edges. Outer spacing flanges, perpendicular to the side edges and parallel and adjacent to the faces, are located on two of the four side edges, either on adjacent or opposing side edges. Inner spacing flanges, perpendicular to the side edges and parallel and adjacent to the faces, are located on two of the four side edges, either on adjacent or opposing side edges. The spacing flanges are positioned such that when one block is fitted to another block, the inner spacing flanges are received within the recess created by the outer spacing flanges of the adjacent block with the outer side faces of the inner spacing flanges abutting the inner side faces of the outer spacing flanges of the adjacent block. Each set of flanges seats upon a side edge of the other block. The interfacing outer spacing flanges and the inner spacing flanges provide support for the two interconnected blocks.

At least one hook receptacle is located along the lower portion of each of the inner spacing flange with the receptacles facing away from the receptacles located on a parallel flange. At least one resilient hook is located along the length of each of the outer spacing flanges and separated from each spacing flange.

Two blocks can be positioned such that an outer spacing flange-bearing side edge faces an inner spacing flange-bearing side of the other block. Thereafter, one of the blocks is pushed into the other. The hook receptacles receive the hooks that "click" into place. One-way ramps on both the hook receptacles and the hooks assure that once the blocks are interconnected, they will not separate. Once interconnected, the top of each spacing flange abuts the side edge of the other block thereby creating a very tight, snug, and mutually supporting fit. A structural bar can be positioned between the blocks within the recess between the inner spacing flanges to create a further tight and snug interfit and to improve structural integrity of any wall, window or door built from the blocks.

Using the construction blocks of the present invention greatly expedites the construction of a partition wall. Once the blocks are positioned, they are merely snapped into place without the need to assemble any connection means. Block interfit is extremely tight and secure. By using interconnection means along the entire length of each block, as opposed to just the corners, redundancy exists in block interconnection and failure of one or more connection means will not result in structural failure of the partition being built. Furthermore, a section of the block may be removed, either a straight section or an arcuate section, permitting non-rectangular-shaped partition wall, window or door construction. Such block section removal will not result in block interconnection failure.

BRIEF DESCRIPTION OF THE DRAWINGS

Similar reference numerals refer to similar parts throughout the several views of the drawings.

Description of the Preferred Embodiment

Figure 1:
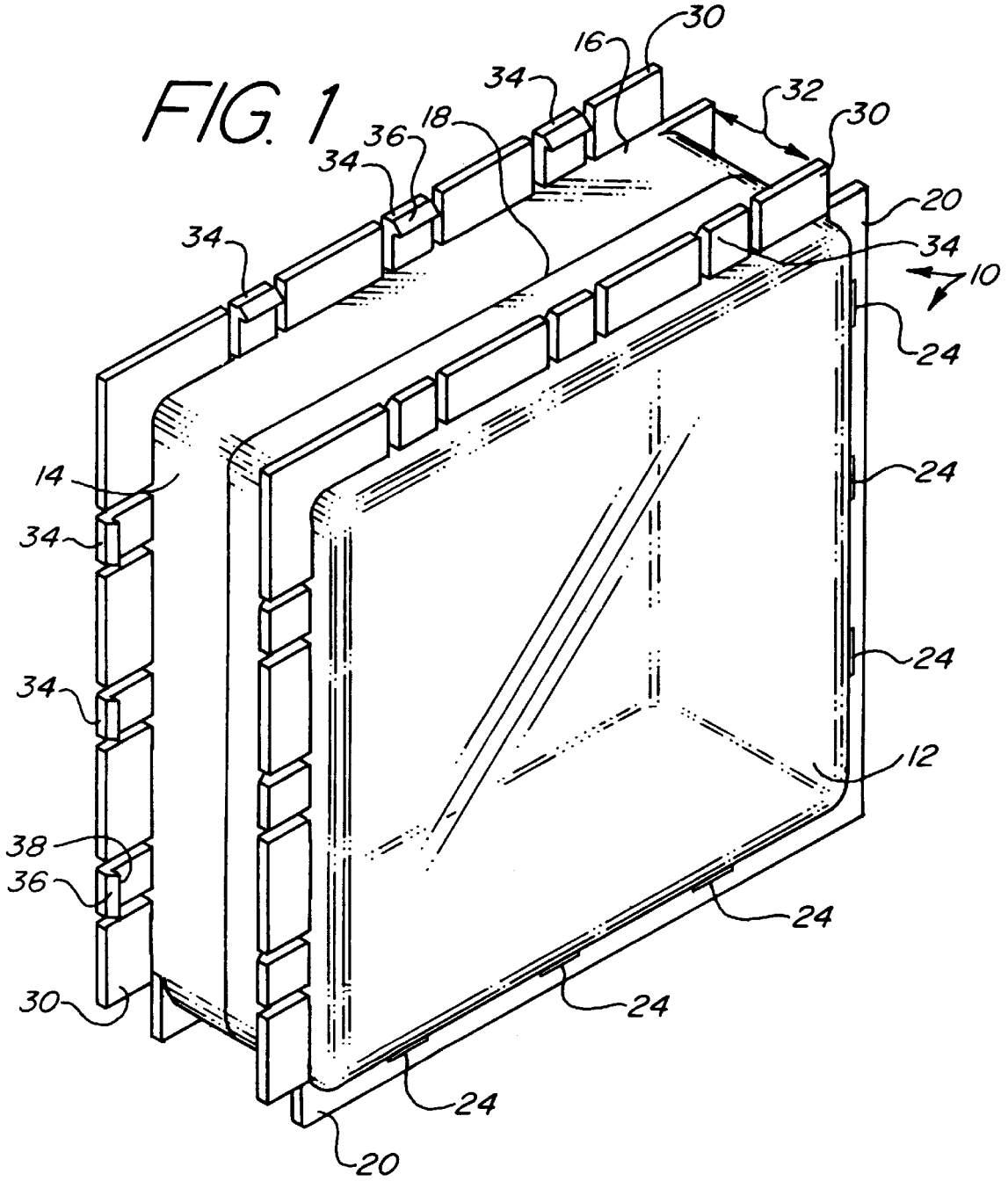
FIG. 1 is a perspective view of the construction block of the present invention showing the outer of spacing flanges.

Referring to the drawings, it is seen that the construction block of the present invention, generally denoted by reference numeral 10, is a generally rectangular form, having a pair of parallel disposed faces 12 joined by four side edges 14. The block 10 may be formed as a single unit, or as shown, as a pair of identical halves 16 joined along a seam 18 in any appropriate fashion. The construction block 10 may be formed from transparent or translucent plastic or other appropriate material. Several blocks 10 can be interconnected and built into a partition wall, a window, a door or any other appropriate device.

Located on two of the side edges 14 is a pair of outer spacing flanges 20 extending perpendicularly outward from the plane of the side edge 14 adjacent and parallel to each face 12. A recess 22 exists between the outer spacing flanges 20. The two side edges 14 that contain the outer spacing flanges 20 can be adjacent side edges 14 or opposing side edges 14. Located on the other two of the side edges 14 is a pair of inner spacing flanges 30 extending perpendicularly outward from the plane of the side edge 14 adjacent and parallel to each face 12. A recess 32 exists between the inner spacing flanges 30. The two side edges 14 that have the inner spacing flanges 30 can be adjacent side edges 14, if adjacent side edges 14 hold the outer spacing flanges, or opposing side edges 14, if opposing side edges 14 hold the outer spacing flanges 20.

Figure 2:
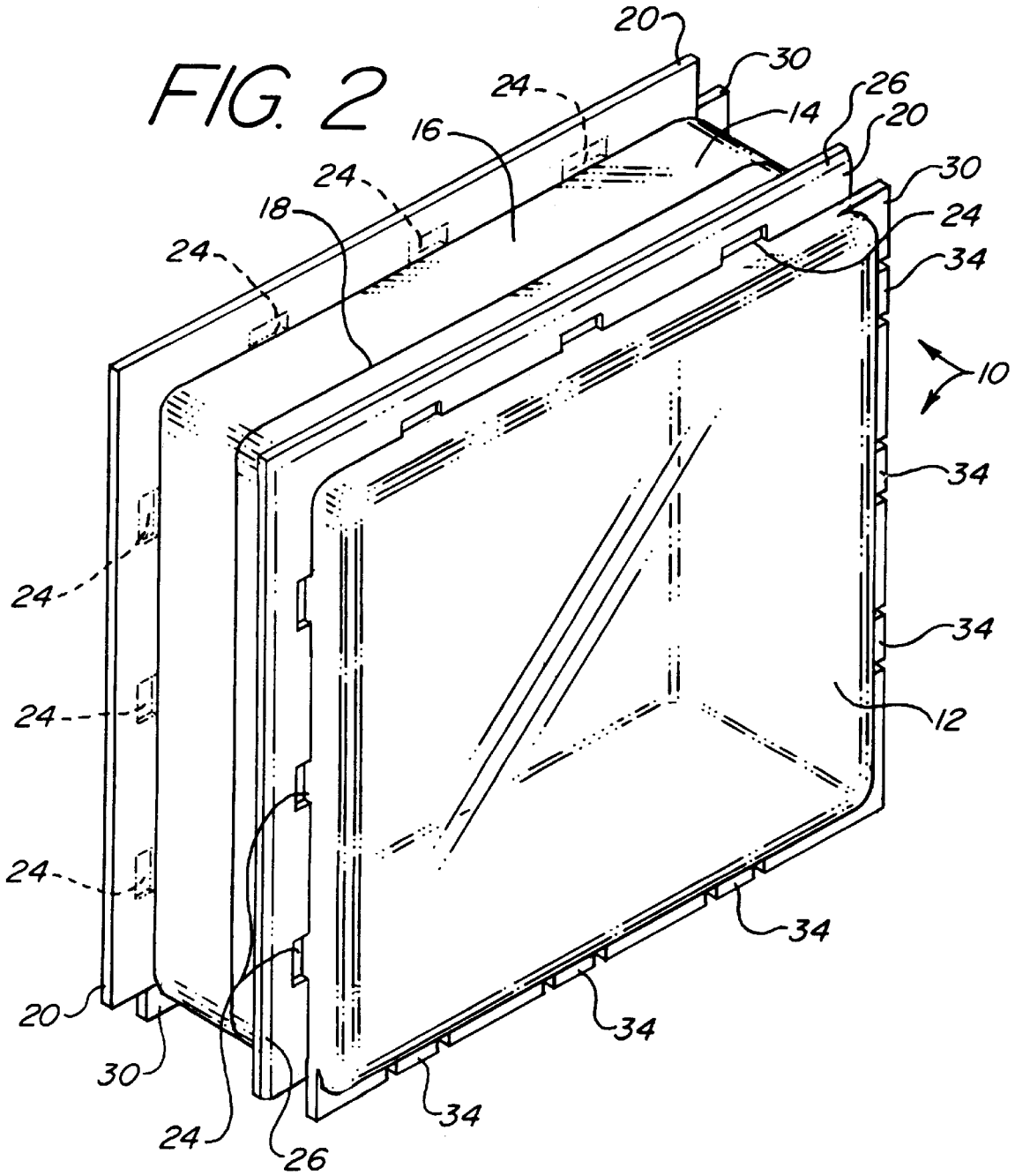
FIG. 2 is a perspective view of the construction block of the present invention showing the inner spacing flanges.
Figure 3:
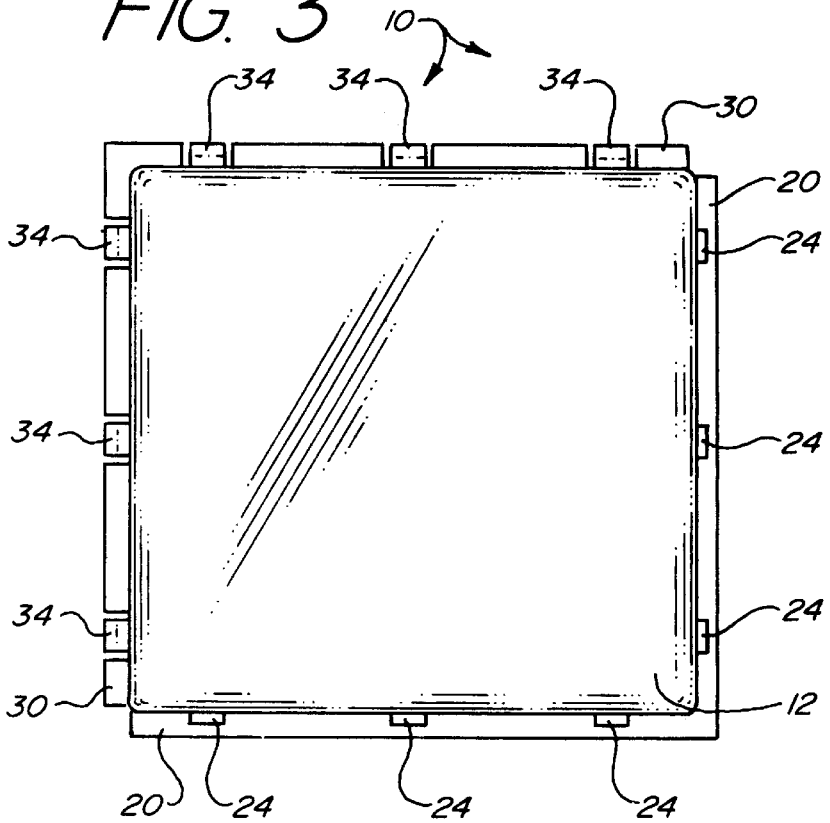
FIG. 3 is a front elevation view of the construction block of the present invention.
Figure 4:
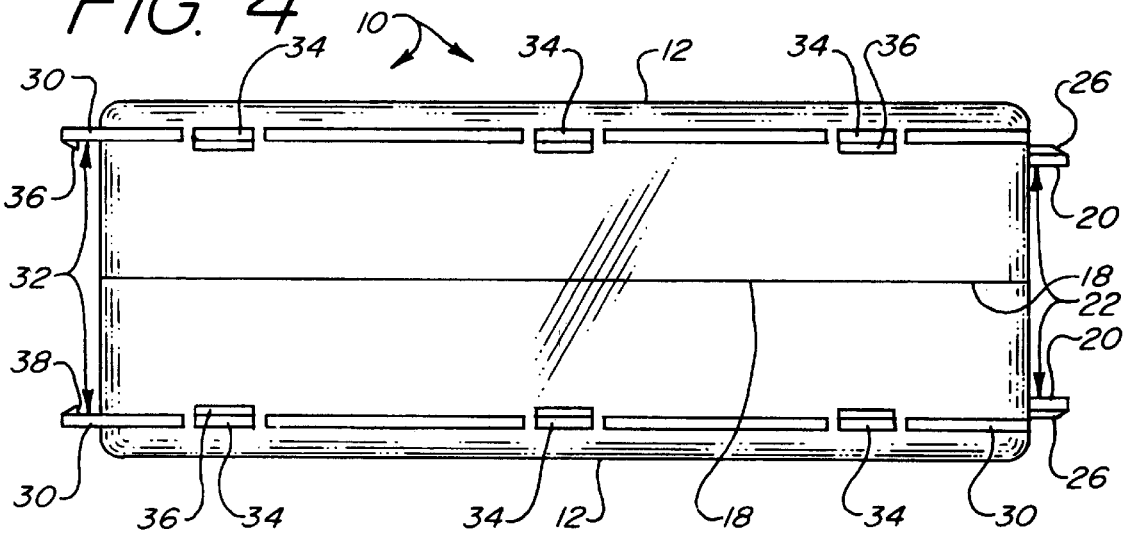
FIG. 4 is a top plan view of the construction block of the present invention.
Figure 5:
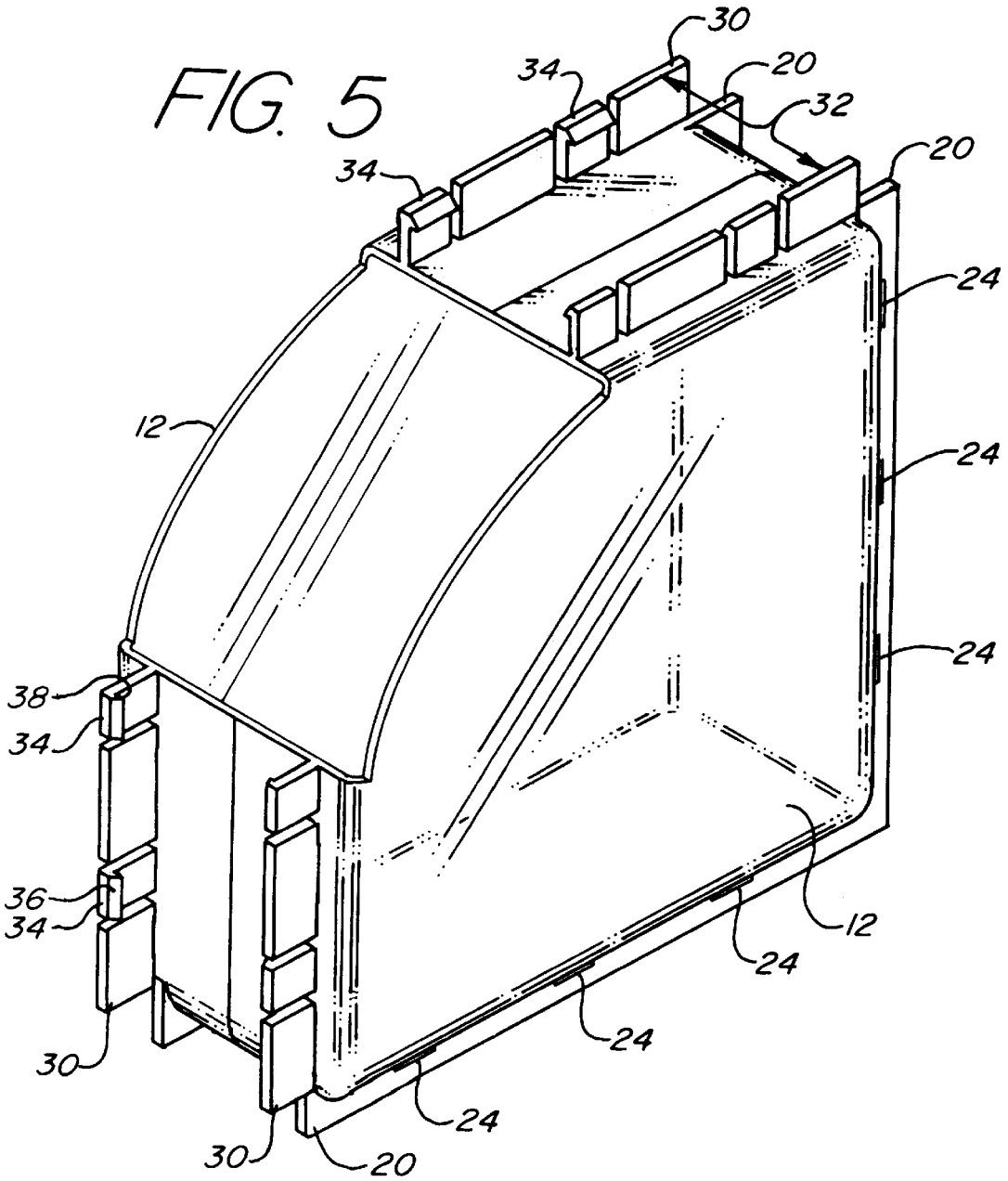
FIG. 5 is a perspective view of the construction block of the present invention with a section of the block removed.
Figure 7:
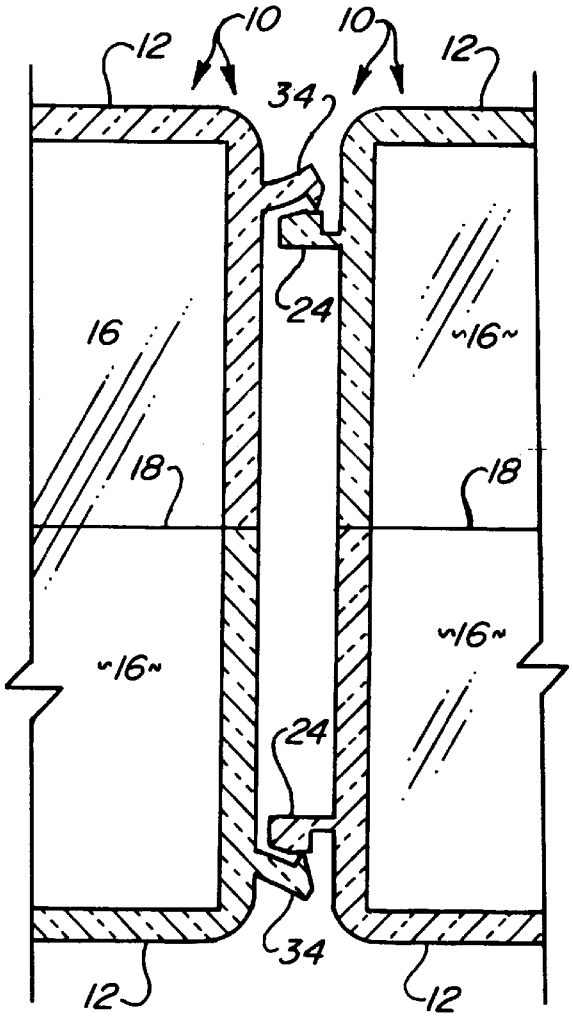
FIGS. 6–8 are cutaway views illustrating interconnection of two construction blocks of the present invention.
Figure 6:
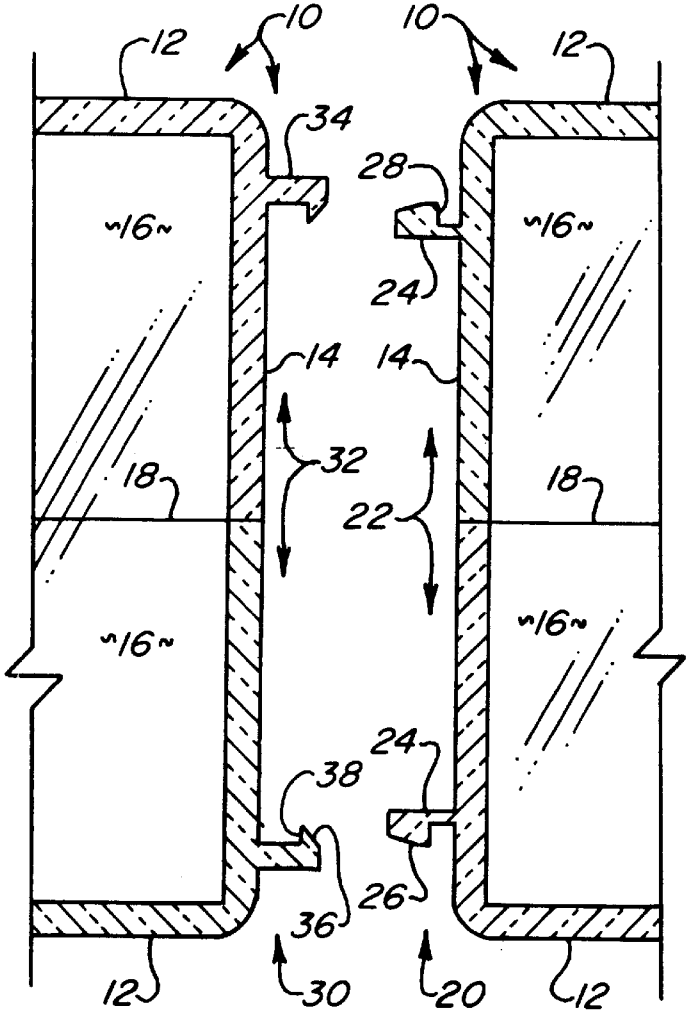
Figure 8:
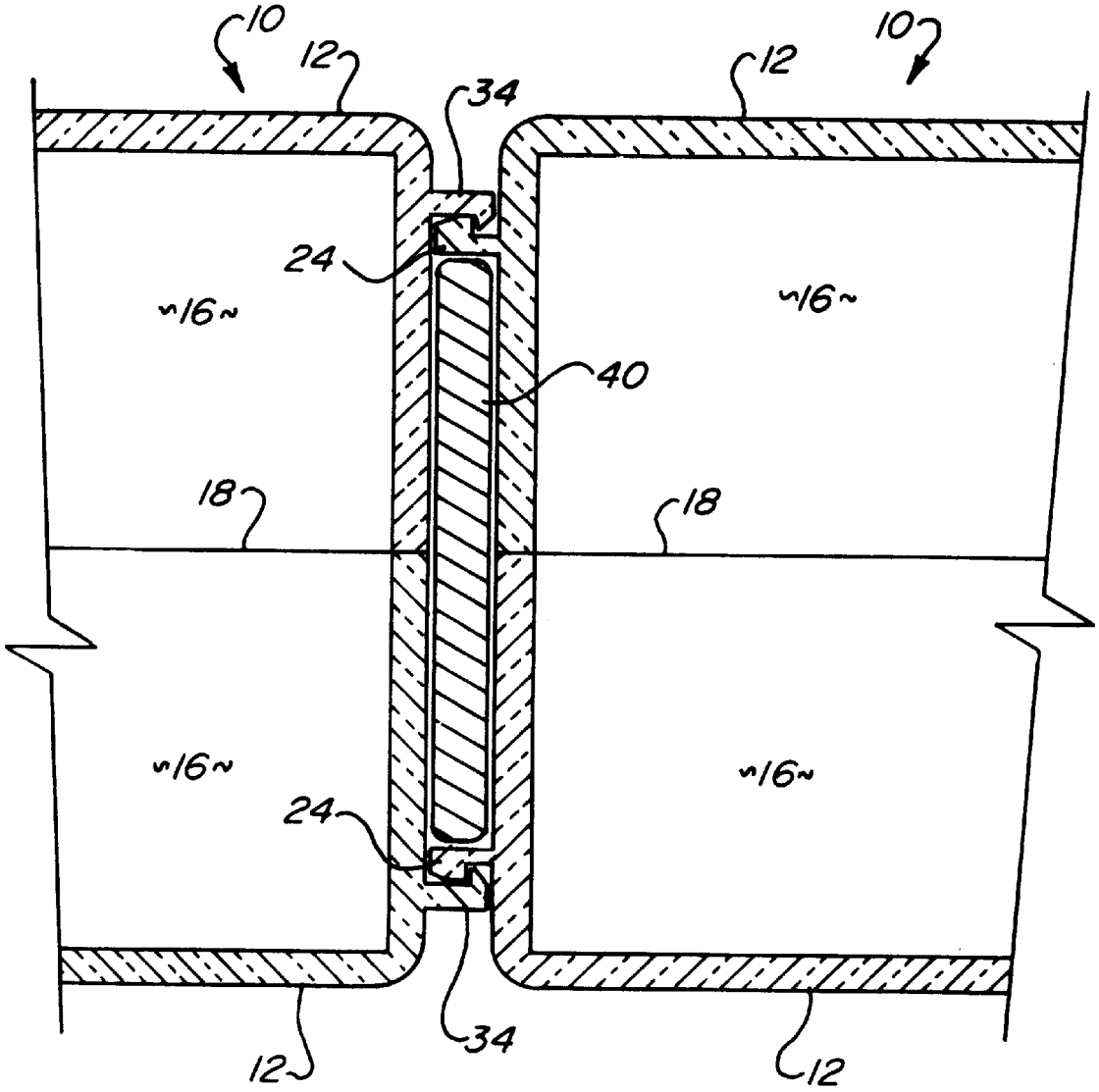

As best seen in FIG. 2, at least one hook receptacle 24 is located along the length of each of the inner spacing flange 20. The hook receptacle 24 has a ramped portion 26 and a lip 28. Hook receptacles 24 face away from other hook receptacles 24 located on a parallel inner spacing flange 20. As best seen in FIGS. 3 and 4, at least one hook 34 is located along the length of each outer spacing flange 30 in corresponding locations along the length of the side edges 14 relative to the locations of the hook receptacles 24. Each hook 34 has a ramped portion 36 and a lip 38. A small void area 40 separates the hooks 34 from the outer spacing flanges 30. The height of the outer spacing flanges 20, inner spacing flanges 30, and hooks 34 are all equal. The inner spacing flanges 30 are positioned closer to the central portion of their respective side edges 14 relative to the outer spacing flanges 20.

In order to interconnect two blocks 10 to one another, the blocks 10 are positioned such that a side edge 14 having inner spacing flanges 30 of one of the blocks 10, faces a side edge 14 having outer spacing flanges 20 of the other block 10. The two blocks 10 are pushed toward one another. This causes the ramped portion 36 of each hook 34 to interact with the ramped portion 26 of the corresponding hook receptacle 24. The hook 34 is formed such that it is sufficiently resilient to bend to permit the two ramped portions 26 and 36 to pass over one another. Once the ramped portions 26 and 36 pass one another, the hook 34 "clicks" into place and returns to its original position. As such, the lip 38 of the hook 34 abuts the lip 28 of the hook receptacle 24. The two lips 28 and 38 hold one another and prevent the blocks 10 from being separated from each other.

In this position, the tops of the outer spacing flanges 20 and hooks 34 of the first block 10 abut the side edge of the second block 10 while the tops of the inner spacing flanges 30 of the second block 10 abut the side edge of the first block 10. This results in a secure and tight fit of the two blocks to each other. If desired, a structural bar 40 can be positioned within the inner spacing flange recess 32 between the blocks after interconnecting the blocks 10 resulting in an even tighter and more secure interfit.

The use of the spacing flanges assures straight and proper alignment of the blocks 10 as a partition wall is being assembled. The use of the cooperating hooks 34 and hook receptacles 24 assures a solid and sturdy interconnection of the blocks 10 that will not fail under normal conditions. Once two blocks 10 are interconnected, the overlap of each of the outer spacing flange 20 with its corresponding inner flanges 30 can be ultrasonically welded to one another to further secure adjacent blocks 10 to each other. The outer faces of the outer spacing flanges 20 form a grout groove.

While the invention has been particularly shown and described with reference to an embodiment thereof, it will be appreciated by those skilled in the art that various changes in form and detail may be made without departing from the spirit and scope of the invention.

I claim:

1. A construction block comprising:

a generally rectangular body having a pair of faces joined by a first side edge, a second side edge, a third side edge, and a fourth side edge;

outer spacing flanges extending about the first side edge and the second side edge adjacent and essentially parallel to the faces;

inner spacing flanges extending about the third side edge and the fourth side edge adjacent and essentially parallel to the faces and where each of the inner spacing flanges lie in a different plane relative to the outer spacing flanges; and at least one hook receptacle located along the inner spacing flanges and facing one of the pair of faces;

at least one hook located along the outer spacing flanges and facing one of the pair of faces each of the at least one hook adapted to be received within a corresponding hook receptacle of the at least one hook receptacle, when the construction block is interconnected with another of the construction block.

2. The construction block system as in claim 1 further comprising a structural bar positioned between the inner spacing flanges when the first body is interconnected with the second body.

3. The construction block system as in claim 1 wherein the construction block formed from translucent plastic.

4. The construction block system as in claim 1 wherein the construction block is formed from transparent plastic.

5. The construction block system as in claim 1 wherein each of the at least one hook receptacle has a one way ramp.

6. The construction block system as in claim 1 wherein each of the at least one hook has a one way ramp.

7. The construction block system as in claim 1 wherein each of the at least one hook receptacle has a one way ramp and each of the at least one hook has a one way ramp.

8. The construction block system as in claim 1 wherein the first side edge is adjacent to the second side edge.

9. The construction block system as in claim 1 wherein the first side edge is adjacent to the third side edge.

10. A construction block comprising:

a generally rectangular body having a pair of faces joined by a first side edge, a second side edge, a third side edge, and a fourth side edge;

outer spacing flanges extending about the first side edge and the second side edge adjacent and essentially parallel to the faces;

inner spacing flanges extending about the third side edge and the fourth side edge adjacent and essentially parallel to the faces and where each of the outer spacing flanges lie in a different plane relative to the inner spacing flanges; and at least one hook receptacle located along the inner spacing flanges and facing one of the pair of faces and facing away from each other when located on parallel inner spacing flanges;

at least one hook located along the outer spacing flanges and facing one of the pair of faces each of the at least one hook adapted to be received within a corresponding hook receptacle of the at least one hook receptacle, when the construction block is interconnected with another of the construction block.

11. The construction block system as in claim 10 further comprising a structural bar positioned between the inner spacing flanges when the first body is interconnected with the second body.

12. The construction block system as in claim 10 wherein the construction block formed from translucent plastic.

13. The construction block system as in claim 10 wherein the construction block is formed from transparent plastic.

14. The construction block system as in claim 10 wherein each of the at least one hook receptacle has a one way ramp.

15. The construction block system as in claim 10 wherein each of the at least one hook has a one way ramp.

16. The construction block system as in claim 10 wherein each of the at least one hook receptacle has a one way ramp and each of the at least one hook has a one way ramp.

17. The construction block system as in claim 10 wherein the first side edge is adjacent to the second side edge.

18. The construction block system as in claim 10 wherein the first side edge is adjacent to the third side edge.

* * * * *